United States Patent [19]

Thourel

[11] 4,005,301

[45] Jan. 25, 1977

[54] MICROWAVE HEAT TREATING FURNACE

[75] Inventor: Leo Y. Thourel, Castanet, France

[73] Assignee: Agence Nationale de Valorisation de la Recherche (ANVAR), France

[22] Filed: June 20, 1975

[21] Appl. No.: 588,723

[30] Foreign Application Priority Data

June 21, 1974 France ..... 74.21570

[52] U.S. Cl. ..... 219/10.55 A; 219/10.55 F

[51] Int. Cl.[2] ..... H05B 9/06

[58] Field of Search ..... 219/10.55 A, 10.55 F, 219/10.55 R

[56] References Cited

UNITED STATES PATENTS

| | | | |
|---|---|---|---|
| 2,763,757 | 9/1956 | Pritchard | 219/10.55 F |
| 3,478,188 | 11/1969 | White | 219/10.55 A |
| 3,581,038 | 5/1971 | Williams | 219/10.55 F |
| 3,749,874 | 7/1973 | Edgar | 219/10.55 A |
| 3,764,769 | 10/1973 | Tang | 219/10.55 F |
| 3,851,132 | 11/1974 | Van Koughnett | 219/10.55 F |

*Primary Examiner*—Arthur T. Grimley
*Attorney, Agent, or Firm*—Robert E. Burns; Emmanuel J. Lobato; Bruce L. Adams

[57] ABSTRACT

A microwave furnace having a tunnel-like structure within which are arranged paired coherent sources of electromagnetic radiation that develop electromagnetic fields that have an interference pattern in which the average density of electromagnetic waves in each cross section of the furance is substantially constant. The paired coherent sources are box horns with each pair connected to a corresponding microwave generator that applies its microwave energy directly to one of the box horns of the pair and applies it through a phase shifter to the other box horn of the pair. The phase shifter shifts the relative phase shift cylically and effects for all points of each cross section an average valve of electromagnetic energy density that is constant over a cycle of variation of each phase shift. The box horns are arranged aligned on opposite sides of the longitudinal axis of the tunnel-like furnace with the radiation openings thereof aligned and extending in the longitudinal direction of the furnace.

13 Claims, 4 Drawing Figures

MICROWAVE HEAT TREATING FURNACE

BACKGROUND OF THE INVENTION

The present invention relates to a tunnel furnace with ultra-high frequency heating comprising sources of irradiation of microwave frequency waves which emit within a tunnel-shaped enclosure; products to be treated are caused to move through this enclosure in its longitudinal direction in order to receive the irradiated energy whose intensity is adjusted in accordance with the application contemplated (heating of products, drying, dehydration, fusion, etc.)

In the known microwave tunnel furnaces, the walls, which are generally of metal, produce the appearance of a system of interferences which make it practically impossible to obtain a constant distribution of energy in the cross sections of the enclosure; for sources disposed, as customary, in the upper part of the enclosure in planes parallel to the transverse planes, this interferential distribution with the presence of minima and maxima is accentuated by reflection of the waves on the lower wall of the tunnel. The interference fringes have positions which depend on the frequency of the waves, the position of the sources and the dimensions of the cavity of the microwave tunnel furnace. The amplitude of the undulation of these fringes is also a function of the nature of the material to be treated; the latter in fact constitutes a dampening element in the cavity of the furnace and the amount of the dampening depends essentially on the dielectric losses of the material, its water content, and its volume.

In practice it is therefore impossible to obtain a distribution of the electromagnetic field which is constant in the transverse planes of the furnace. This defect is extremely disturbing in most applications since it results in a non-homogeneous treatment of the products.

SUMMARY OF THE INVENTION

The present invention is directed at alleviating this drawback and in providing a microwave frequency heating furnace adapted to effect a homogeneous treatment of the products throughout their entire volume.

For this purpose a tunnel furnace with microwave frequency heating comprising sources of irradiation of microwave frequency waves arranged to emit within a tunnel-shaped enclosure through which the products to be treated are caused to move in longitudinal direction is characterized by the fact that at least two coherent sources of electromagnetic irradiation are coupled to compose within transverse sections of the furnace the electromagnetic fields which they generate, said sources being associated with a variable phase shifter adapted cyclically to vary their relative phase shift.

Each phase shifter is advantageously adapted to vary said relative phase shift between 0° and 180°; the variation produced by each phase shifter may in particular be sinusoidal and of a frequency at least equal to a few cycles per second.

In accordance with a preferred embodiment, several sources of electromagnetic irradiation are coupled transversely in pairs, the pairs being approximately uniformly distributed along the tunnel-shaped enclosure. The sources of irradiation of each pair are connected to microwave frequency generator which discharges directly into one of the sources of the pair in question and, via the phase shifter, into the other source.

The cyclic phase shift introduced between the relative phases of the coupled sources results in a rapid variation of the position of the interference fringes and makes it possible to obtain a resultant electromagnetic field which is variable in time, the average value of which is substantially constant whatever the amplitude of the interference undulations. Thus in each transverse section the average energy during a period of variation of the phase shift is constant whatever the zone of the cross section taking into account the relatively large inertia of the thermal phenomena, the heating of the product is substantially homogeneous in each cross section if the period of variation of the relative phase shift of the sources is small, particularly less than a second. As the products to be treated move longitudinally through the tunnel, the homogeneity in each cross section determines the homogeneity of treatment throughout the entire volume of the product after passage through the tunnel furnace, whatever the differences in treatment which exist from one cross section to another.

The sources of electromagnetic irradiation may be of any known type; in particular, each source may be a linear source of the slotted wave-guide type, disposed in the longitudinal direction of the enclosure. These sources may also be formed by over-dimensioned wave guides with radiant opening known as box horns; the selection of this last mentioned type of source is of interest in order to effect a dehydration under vacuum of the products due to the total elimination of the risks of ionization which exist in the case of linear sources if the power put in play is high.

BRIEF DESCRIPTION OF THE DRAWING

The following description read with reference to the accompanying drawings sets forth by way of illustration and not of limitation one embodiment of the invention; in the drawings.

DESCRIPTION OF THE PREFERRED EMBODIMENTS

Figure 1:
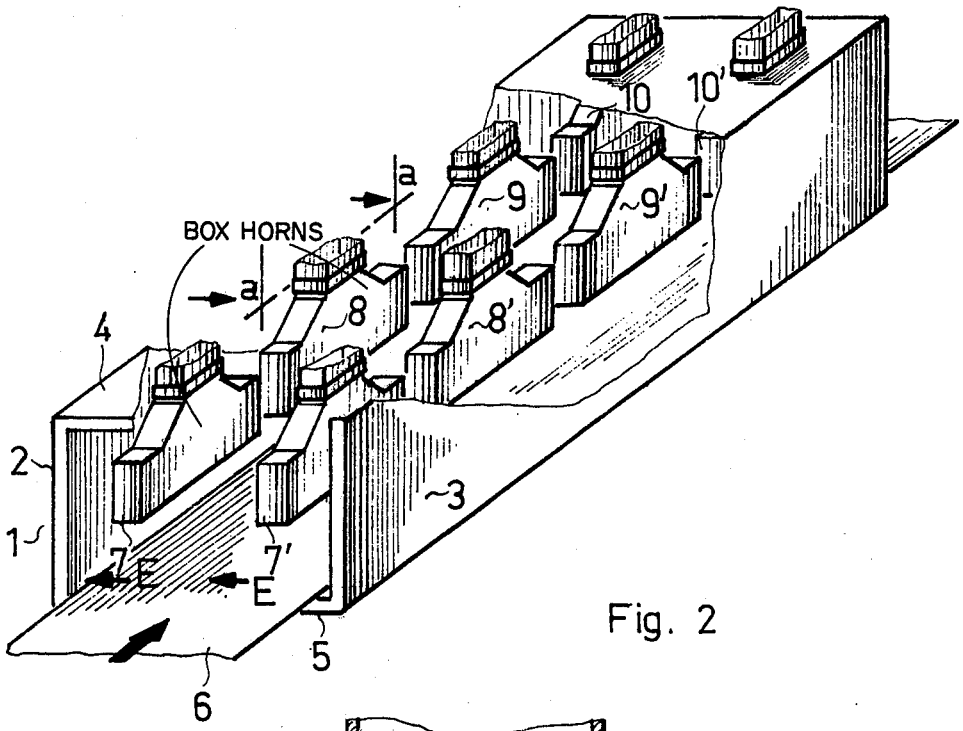
FIG. 1 is a perspective diagrammatic view of a tunnel furnace in accordance with the invention, partially broken away.

The furnace shown diagrammatically by way of example in FIG. 1 is formed of an enclosure 1 in the form of a parallelepiped tunnel, bounded by two side walls 2 and 3, a top wall 4 and a bottom wall 5 above which there moves a conveyor belt 6 on which the products to be treated are placed in order to cause them to move through the inside of the container 1 from one end thereof to the other.

This enclosure is equipped at its upper portion with several pairs of box horns (7, 7', 8, 8', 9, 9' and 10, 10' in FIG. 1). The box horns of each pair are coupled transversely to form the electromagnetic field which they generate in each cross section subjected to their electromagnetic radiation. Thus the box horns 7 and 7' are arranged opposite each other symmetrically with respect to the longitudinal axial plane of the tunnel, as well as the box horns 8 and 8', 9 and 9' and 10 and 10'. Furthermore, the box horns 7, 8, 9, 10 located on one side of the axial plane are aligned with respect to each other so that their radiating opening is arranged along a longitudinal line; the same is true of the other box horn of each pair 7', 8', 9' and 10'.

Figure 2:
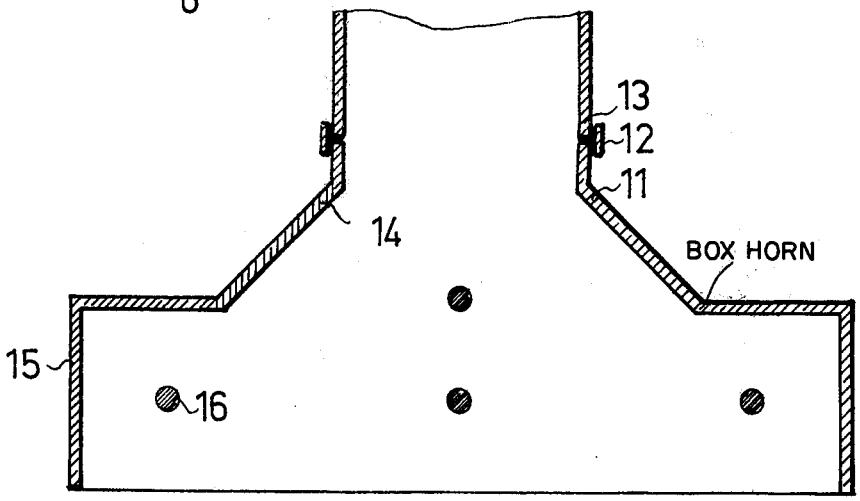
FIG. 2 is a partial section through a longitudinal plane aa of a box horn with which said tunnel furnace is provided.

FIG. 2 shows a box horn in longitudinal section along a plane aa; this box horn comprises at its inlet a wave guide 11 which makes it possible to connect it, in particular by means of a flange 12, to a wave guide 13 by which this box horn is fed. The wave guide 11 is followed by a trapezoidal portion 14 which flares out to a parallelepiped cavity 15 whose open lower face forms the opening for radiation of the box horn.

Furthermore, short-circuit pillars such as 16, for instance four of them, connect the side walls of the cavity 15 so as to act on the amplitude and phase distribution of the wave radiated along the lower opening of the cavity; depending on the frequency, the dimensions of the different parts of the box horn and the arrangement of the short-circuit pillars 16 are determined experimentally to make the amplitude of the wave along the radiant opening of the box horn as uniform as possible. For example, for a frequency of 2450 megacycles, the arrangement shown in FIG. 2 makes it possible, with a radiant opening of about 50 cm in length to reduce the amplitude variation of the wave along said opening to a value less than 3 decibels.

Figure 3:
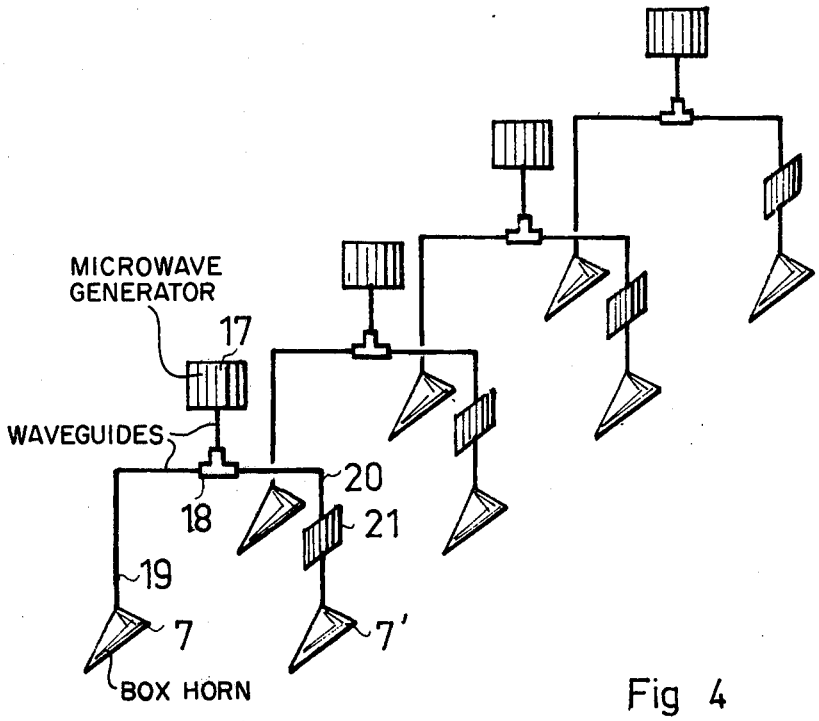
FIG. 3 is a diagram showing the mounting of the box horns of the tunnel furnace.
Figure 4:
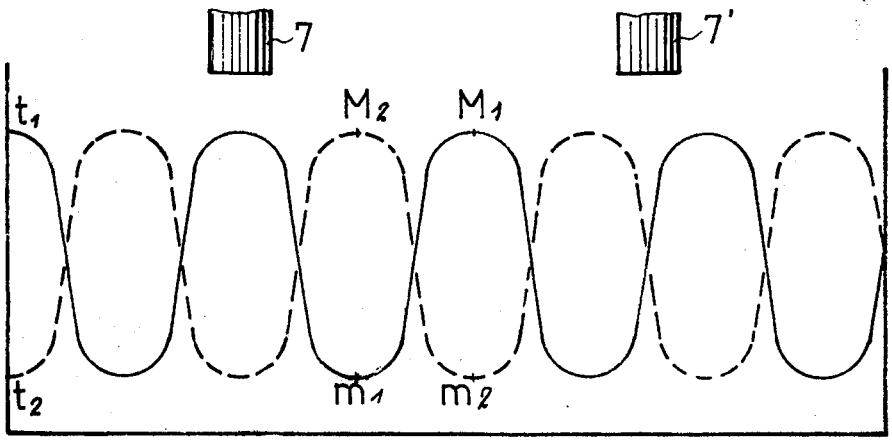
FIG. 4 is a diagram showing in a transverse plane the interference states appearing in the tunnel furnace at two moments t1 and t2.

Each pair of box horns is fed by microwave frequency generator such as indicated at 17 in FIG. 3, which discharges into a divider tee 18 which distributes the energy towards a wave guide 19 and a wave guide 20. The wave guide 19 is directly connected to one box horn of the pair in question, in the example shown box horn 7, while the wave guide 20 is connected to the other box horn 7' of this pair via a variable phase shifter 21. This variable phase shifter, of known type, is adapted to cyclically vary the phase shift of the box horn 7' between 0° and 180° at a frequency of a few cycles per second; this phase shifter may be a sinusoidal variation phase shifter. In this way the phase of the box horn 7 and, in similar manner, the phases of the box horns aligned with it remain constant, while the phase of the box horn 7'and the phases of the box horns aligned with the latter vary between 0° and 180° several times a second; the box horns of a pair arrive cyclically in phase at moments *t*1 and, in phase oposition, at moments *t*2. The interference state present in each transverse plane therefore undergoes the same cyclic variations which upon each cycle reverse the maxima and the minima of the fringes; thus the maximum M1 present in one zone at a moment *t*1 is replaced at a moment *t*2 by a minimum M2, in the same manner as the minimum M1 present in another zone at the same moment *t*1 is replaced by a maximum M2 at the moment *t*2. Therefore the energy distribution is substantially constant over a cycle of variation in each transverse plane of the tunnel. It should be noted that the electrical field E generated by a box horn is perpendicular to the longitudinal axial plane of the box horn; as each box horn is arranged in such a manner that its longitudinal axial plane is parallel to the side walls of the tunnel, the electrical field appearing in the furnace is perpendicular to the side walls 2 and 3 thereof; in this way the field is not zero at any moment along these walls (as would be the case if it were parallel to them) and the energy distribution in the vicinity of the said walls is the same as that which is present at the center of the cross sections; in this way one eliminates the existence of passive zones in the vicinity of the walls, in which the product would undergo less treatment.

It will be understood that the preceding description is not limitative and that other methods of feeding box horns can be used which are adapted to the powers put in play, one or more phase shifters of suitable nature making it possible in all cases to vary the phase of the electromagnetic waves radiated by one of of the rows of box horns.

The use of box horns has been indicated merely by way of example and any other source of irradiation of microwave frequency waves can be used; the use of box horns is of interest when the treatment contemplated consists of a dehydration under partial vacuum with high power since most of the other radiant sources are subject to disturbing ionization phenomena.

I claim:

1. Tunnel furnace for microwave frequency heating, comprising, a tunnel-shaped enclosure through which in operation articles to be treated are caused to move in longitudinal direction of the tunnel-shaped structure; paired coherent sources of microwave electromagnetic radiation coupled to develop in cross sections of the tunnel-shaped enclosure electromagnetic fields; a phase shifter connected to said sources and which is variable in time to vary the relative phase shift of said coherent sources cyclically to effect for all points of each cross section of said tunnel-like structure an average value of electromagnetic energy density constant over a cycle of variation of a phase shift.

2. Tunnel furnace according to claim 1, in which said phase shifter comprises means to vary the relative phase shift of the coherent sources of radiation between zero and 180°.

3. Tunnel furnace according to claim 2, in which said means in said phase shifter comprises means to produce a sinusoidal variation of the relative phase shift.

4. Tunnel furnace according to claim 1, in which said phase shifter comprises means to produce a variation of the phase shift of a frequency at least equal to a few cycles per second.

5. Tunnel furnace according to claim 1, including other paired coherent sources of electromagnetic radiation similar to the first-mentioned coherent sources and coupled transversely in pairs, the pairs being substantially uniformly distributed along the tunnel-shaped enclosure and each pair of coherent sources having a phase shifter connected thereto constructed similarly to the first-mentioned phase shifter.

6. Tunnel furnace according to claim 5, for each pair of coherent sources of electromagnetic radiation a microwave frequency generator connected to discharge directly into one of the sources of the pair and connected to discharge via a corresponding phase shifter into the other coherent source of the pair.

7. Tunnel furnace according to claim 6, in which each source of electromagnetic radiation is a linear source, of the slotted wave guide type, arranged in the longitudinal direction of the enclosure.

8. Tunnel furnace according claim 6, in which each source of electromagnetic radiation is an over-dimensioned wave guide consisting of a box horn with a radiation opening.

9. Tunnel furnace according to claim 8 in which box horns of the different pairs of coherent sources are arranged in the tunnel-like enclosure in such a manner that their radiant openings are aligned along two longitudinal lines on opposite sides of a longitudinal axis of said tunnel like structure.

10. Tunnel furnace according to claim 8 in which short-circuit pillars are arranged within each box horn disposed to make the amplitude of radiation waves of the electromagnetic radiation uniform along the radiation opening of the corresponding box horn.

11. A microwave tunnel furnace comprising, means defining a tunnel enclosure having open ends, at least two sources of microwave energy being disposed opposite to each other in said tunnel structure in spaced relationship to develop within said tunnel structure an electromagnetic field; each of said coherent sources comprising two radiators for radiating electromagnetic waves, a microwave generator connected to apply microwave electromagnetic radiation directly to one of said radiators, a phase shifter connected between the microwave generator and the other of said radiators to receive said electromagnetic radiation from said microwave generator and apply it to the other of said radiators for varying the relative phase of said two radiators to effect for all points of each cross section of the tunnel-like structure an average value of the electromagnetic radiator density constant over a cycle of variation of a phase shift.

12. A microwave tunnel furnace according to claim 11, including means to transport articles to be treated in said tunnel-like structure in a longitudinal direction of said tunnel-like structure through said electromagnetic field.

13. A microwave tunnel furnace according to claim 11, in which each radiator comprises a box horn, waveguide means connecting said microwave generator to said one radiator and to said phase shifter independently and a waveguide connecting said phase shifter to said other radiator.

* * * * *